United States Patent [19]

Allen et al.

[11] 4,404,837

[45] Sep. 20, 1983

[54] PRESS TRANSFER BAR

[75] Inventors: Robert J. Allen, Daly City; Edward W. Blake, Orinda, both of Calif.; Manjeshwar S. Rao, Hoffman Estates, Ill.; Kurt L. Hahn, San Rafael, Calif.

[73] Assignee: American Can Company, Greenwich, Conn.

[21] Appl. No.: 438,121

[22] Filed: Nov. 1, 1982

Related U.S. Application Data

[62] Division of Ser. No. 56,704, Jul. 11, 1979, Pat. No. 4,373,370.

[51] Int. Cl.[3] ..... B21D 72/00

[52] U.S. Cl. ..... 72/349; 72/405; 72/421; 198/621; 198/745

[58] Field of Search ..... 72/346, 347, 348, 349, 72/405, 421, 356; 198/621, 745; 414/225, 226, 750, 751, 753, 757

[56] References Cited

U.S. PATENT DOCUMENTS

| | | | |
|---|---|---|---|
| 2,933,180 | 4/1960 | Dixon et al. | 198/745 |
| 2,934,194 | 4/1960 | Adams | 198/621 X |
| 3,011,464 | 12/1961 | Danley et al. | 72/405 |
| 4,127,023 | 11/1978 | Jensen | 72/405 |
| 4,262,510 | 4/1981 | Allen et al. | 72/405 X |

*Primary Examiner*—Leon Gilden

*Attorney, Agent, or Firm*—Paul R. Audet; Aaron Passman; Stuart S. Bowie

[57] ABSTRACT

An inverted press for producing multiple drawn metal containers combines in one press the functions of cupping and drawing presses. The press includes a blanking and cupping station and several drawing and redrawing stations, disposed one adjacent the other and rendered serially operative by a vertically reciprocable slide assembly. At each stage of operation the material, semifinished article or finished article is under complete control. A method for producing a drawn container by multiple forming and reforming of a drawn article, is also provided.

1 Claim, 16 Drawing Figures

FIG. 3
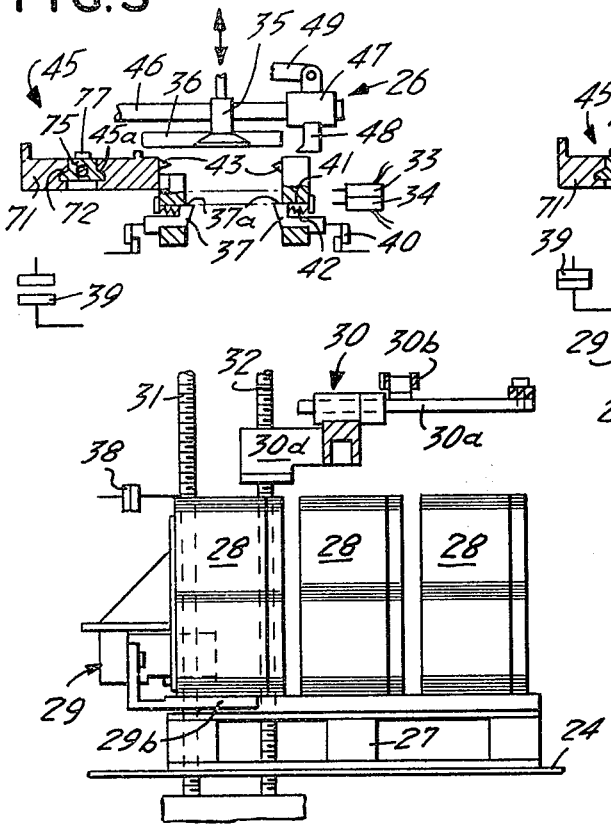
FIG. 3A
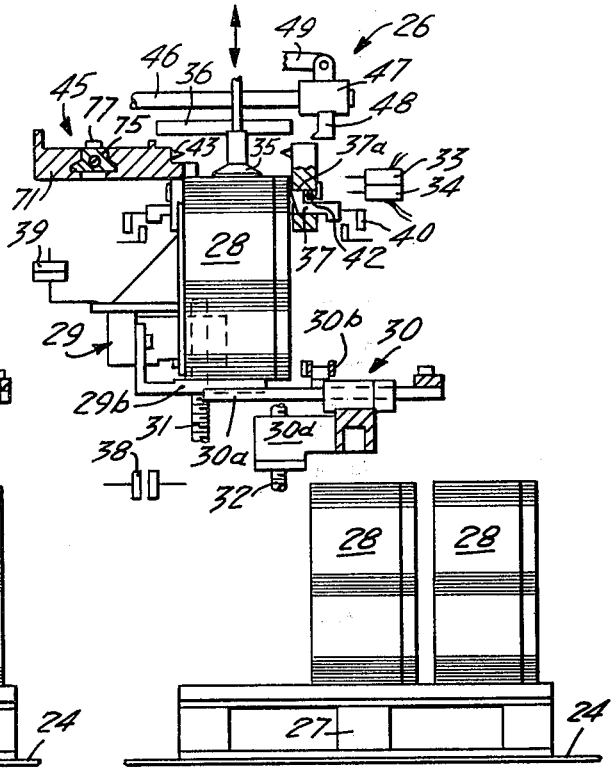
FIG. 3B
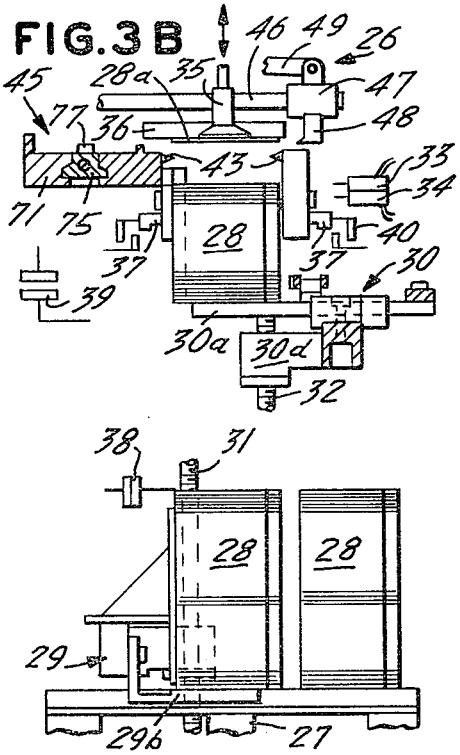
FIG. 3C
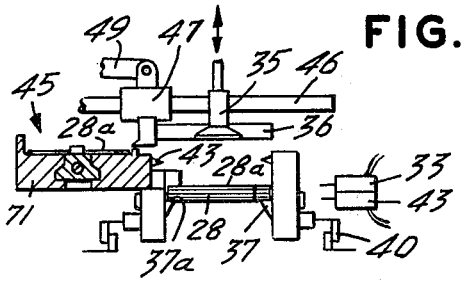
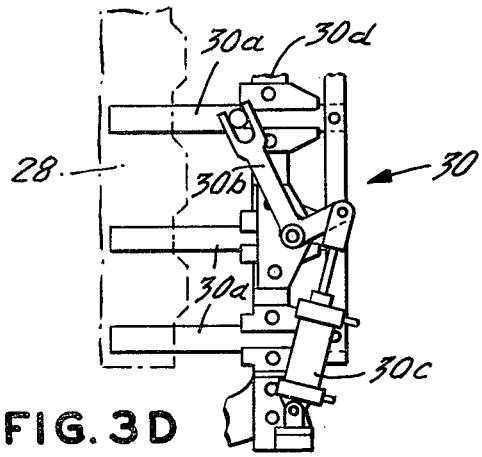
FIG. 3D FIG. 8
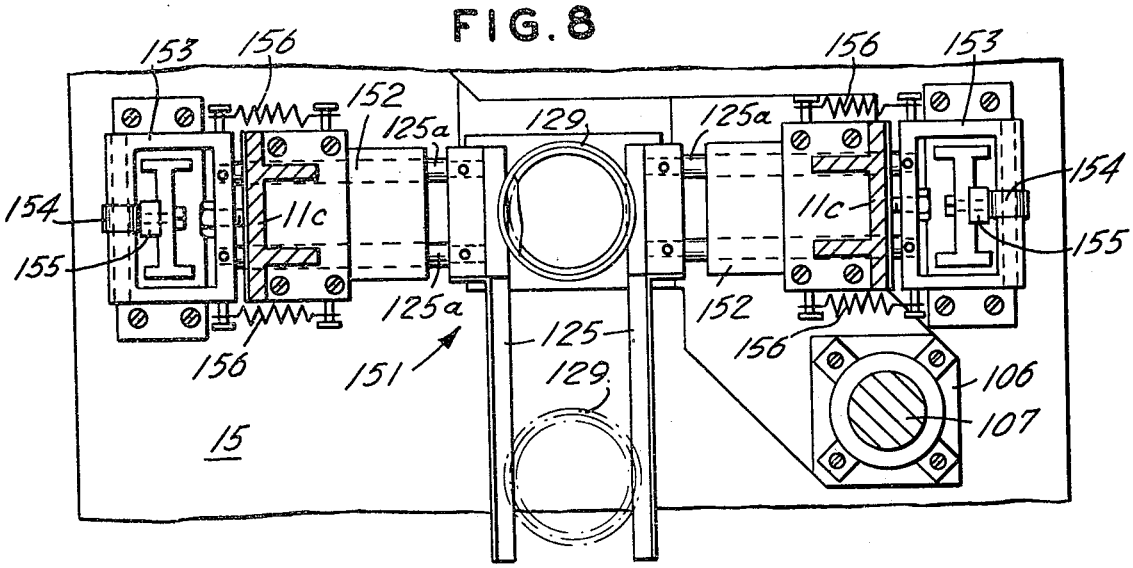
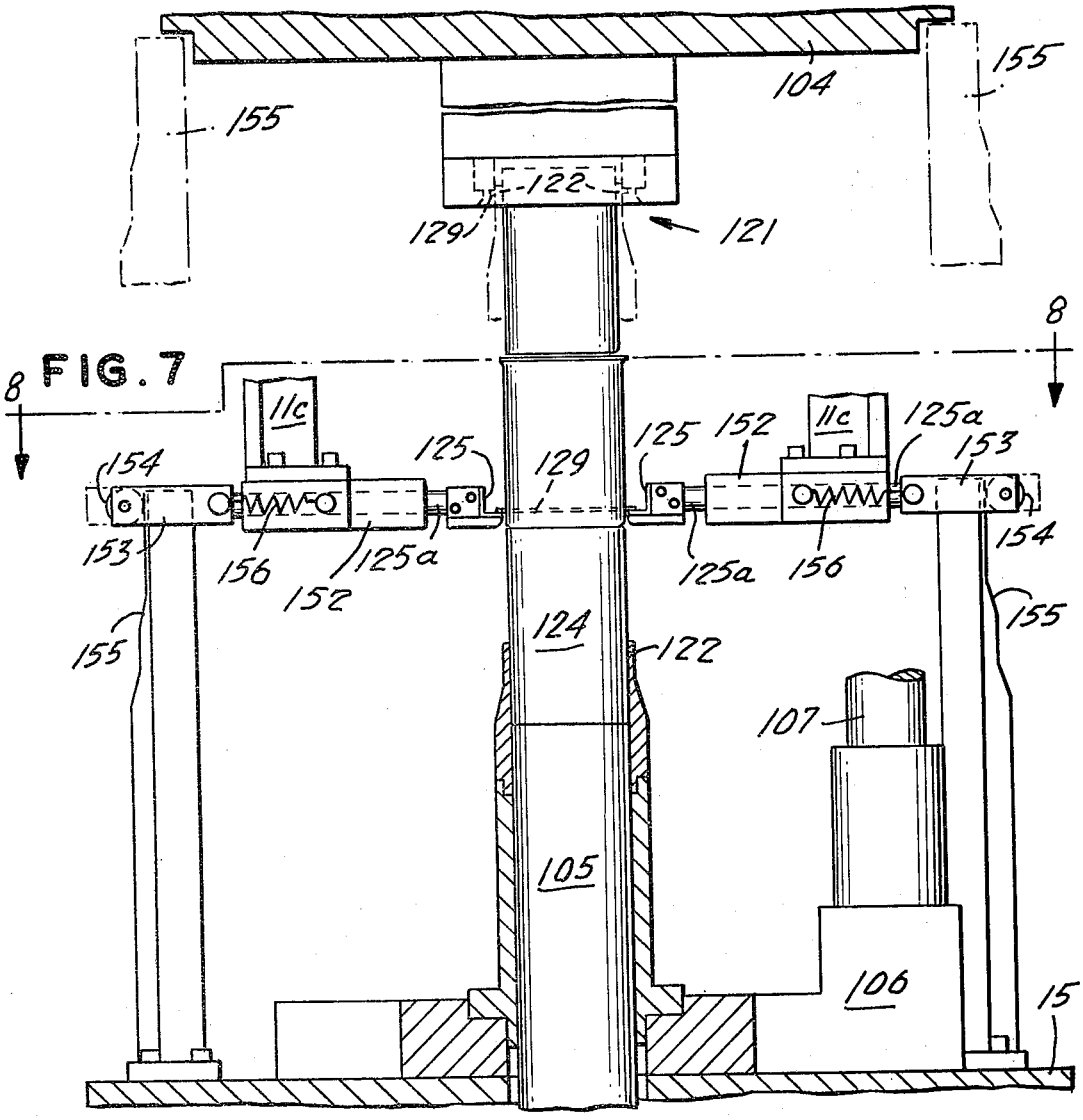
FIG. 7

PRESS TRANSFER BAR

This is a division of application Ser. No. 56,704, filed July 11, 1979, now U.S. Pat. No. 4,373,370.

BACKGROUND OF THE INVENTION

Various types of presses have previously been employed to produce thin metal containers, such as those of the cylindrical drawn metal type usually having greater longitudinal dimensions than lateral dimensions. However, such prior art machines have tended to have certain drawbacks: e.g., undue complexity, excessive space requirements of operation and contamination control, and excessive power consumption. More particularly, such processes require unnecessary transfer of partially formed containers from one press to another during multiple drawing thus subjecting same to damage.

Attempts have been made to improve upon the above-noted deficiencies; for example, the presses described in U.S. Pat. Nos. 3,683,665 and 4,026,226, the latter being an inverted press. It is common to strip feed a press by angling a stack of strips so that the top strip can slide from the stack with the aid of gravity. It is uncommon to feed metal strips into a drawing press by means of lifting strips off a horizontally disposed stack and then individually feeding them. More particularly, a conveyer and elevator system adapted to provide a continual supply of specifically positioned strips for a lifting and feeding means is unique. The invention includes means for prelubricating the strip before forming and in that regard the U.S. Pat. No. 2,302,856 shows a reciprocating die for pumping lubricant while U.S. Pat. No. 2,107,577 shows a system for oiling near a cutting edge. None of the art include a technique which confines the lubricant to a specific predetermined area and include interrupting means to prevent lubrication when there is no strip. While it is common to progressively form drawn articles carried along a planar path through a progressive press; typical of such a progressive press is U.S. Pat. No. 1,725,330. However, so far as it is known, no presently available press affords the advantages of that of the instant invention, nor lends itself to the production of containers by the highly accurate, facile and economic method herein set forth. In progressive presses it is common to transfer the worked on article from station-to-station as it is progressively formed. Commonly, articles are transferred by carrying them with the scrap. In addition, complicated and heavy transfer mechanisms have been used to transfer individual semifinished articles as necessary, see for example U.S. Pat. Nos. 3,800,583 and 3,620,382. None of the prior art, however, include a light weight low inertia mechanism which pivots toward the containers and thus permits high-speed handling. Rarely do such presses include a system for handling semifinished articles which are so different in shape as to require additional means to maintain a portion of each within a common plane thereby facilitating handling. However, so far as it is known, no presently available press affords the advantages of that of the instant invention, nor lends itself to the production of containers by the highly accurate, facile and economic method herein set forth.

Accordingly, it is an object of the present invention to provide a novel press which is compact, and of relatively simple design, and which is economical, durable and convenient to use.

It is also an object of this invention to provide a novel press which is efficient and is capable of smooth, high-speed operation by means of minimizing the handling of the container necessary during forming.

A further object of this invention is to provide a novel press which minimizes contamination of the containers produced.

Still another object of the invention is to provide a novel press having the foregoing features and advantages, which is especially adapted for the production of drawn thin metal containers, and particularly, multiple drawn containers having a greater depth than diameter.

A more specific object of the invention is to provide a novel metal can drawing press in which operations of cupping, drawing, redrawing and trimming are accomplished with each stroke of the press with constant control over the position and location of the can during forming.

Yet another object is to provide a novel and facile method for the production of a drawn container by multiple forming and reforming of a drawn container on a press of the following description.

SUMMARY OF THE INVENTION

It has been found that certain of the foregoing and related objects of the invention are readily attained in a press having a frame, a pair of vertically-spaced, interconnected platens supported on the frame one of which can move relative to the other. The platens having tooling disposed on their opposing faces. The tooling on one of the opposing faces of the platens and on the confronting opposite face of the other platen present a series of forming stations. The lower platen is atop a movable slide, and is mounted for vertical movement, enabling coaction of the tooling associated therewith and the tooling on the upper platen thereby establishing the multiple forming stations. The press also has means for vertically reciprocating the movable slide to render operative the forming stations, and means for transferring a workpiece from forming station to forming station, etc. for effective progressive sequential operations.

As part of the process and to feed the press, a power driven roller conveyer moves pallet loads of single row scroll strips in stacks into position for lifting by an elevator. The elevator provides a continuous supply of scroll strips to a strip feed mechanism. With the pallet in position, an elevator unloader fork raises one stack of strips to a level for strip feed where suction cups remove strips one at a time. When the height of the stack falls below the position of a high level sensor, feeder forks extend under the stack raise and lift it up to the height of the high level sensor; the load having been removed from the unloader forks permits them to lower to their starting position and the conveyor motor advances the pallet so that those forks are under the next row of strips.

The feeder forks rise to maintain the stack of strips at the strip feed level. When the feeder forks are fully raised, the support of the remaining strips is taken over by spring operated support fingers. Then the feeder forks lower and retract to their starting position, and the unloader forks raise the next stack of strips and the cycle is repeated.

The raised stack of strips are held near tin line or at a strip feed level and four air operated vacuum cups lift the topmost strip until it is held by magnets positioned at the tin line. The inserters push the strip laterally into the strip feed guide through which the strip is advanced one cut edge (the diameter of a blank) and a distance for scrap allowance into the blanking and cupping station of the press. The vacuum cups lower and the next strip is lifted to repeat the cycle so that a new strip is available to be inserted into the guide when the preceding strip has advanced through the press.

Each strip is spot lubricated by preformed pads which places a predetermined lubricant pattern on both sides of the strip for aiding drawing. The lubricating station is located between the point of strip feed and the blanking and cupping station for lubricating coated or uncoated strips with a draw compound. Each lubrication pad has absorbent material on contact surfaces which are saturated by adjustable positive displacement spray injectors. The injectors operate only when strips pass through the station where the pads intermittently contact the strip in the area within the cut edge.

The press is an inverted type with all moving parts below the tin line. The punches are resiliently mounted to a top platen supported by the press crown to provide a predetermined resistance. The dies are mounted below on a slide and move up and down during the container forming operations. Also the dies cooperate with stationary pedestals designed to maintain the container flange at the tin line (a common horizontal plane) within the press. The can is drawn downwardly from its flange in subsequent stations. The lower tooling, associated with fixed or stationary pedestals, acts on the upstroke of the slide assembly by moving upward relative to the stationary pedestals. Similarly, the tooling of the upper platen acts to support portions of the workpieces carried in the common plane.

In the preferred embodiment, the tooling associated with each of the forming stations performs at least one forming operation on the container and then transfer means successively shifts the workpieces from one station to another or one set of tools to another.

The stations are desirably linearly-aligned, and the transfer means is comprised of an advancing mechanism carried by the press frame for horizontal reciprocation parallel to the common plane. The advancing mechanism being operated by reciprocating means in synchronism with the downward movement of the slide assembly. The mechanism has a plurality of cam actuated finger sets each having a pair of fingers carried opposite one another which coacted to pivot, grasp and move the workpieces from station-to-station. The workpieces are positioned for grasping and movement from the fixed pedestals which are arranged to support a portion of each semifinished workpiece in the common plane.

In the especially preferred embodiment the transversely fed strip at the initial station is blanked and cupped and the finger sets are pivotally mounted on the mechanism carriage for arcuate movement of their distal parts toward each other to engage the formed cup therebetween to thereby shift it with the carriage to effect the transfer of the cup to the next station. More particularly, reciprocating devices shift the mechanism carriage and move the fingers in timed synchronized relation to the slide action movement. It is also desirable that the mechanism include additional sets of fingers, which further shift the workpiece (now a partially drawn container) to each subsequent station for further forming or trimming.

The first pair of fingers are in alignment with a pedestal in a first position before grasping and moving the container to a second position in line with the next adjacent pedestal. Each of the first and second positions is aligned with the central axis of a pedestal which is also the axis of a forming station. The timing of the stock feeding and workpiece transfer is related to the slide movement. There is also the provision of means for removing scrap and finished articles from the press.

In the method of operation pallets of precoated and rescrolled strips of stock are automatically removed from the pallet and conveyed to the initial die. The press is of the inverted type with the dies mounted on the slide and the resiliently supported punches affixed to the crown. During operation the strips are transversely advanced into the initial station for blanking, there the die interfaces with its blanking punch to separate a blank or disc of metal from the strip. After blanking, the operation of the cup forming is continued in the same station by a preliminary die which causes the blank to be drawn into a cup as the die mates with its cupping punch. When the die descends, the cup is carried with it. The die retains control until the cup has been securely positioned on a stationary support pedestal centered along the axis of the particular die. The strip scrap eventually passes on and is discharged as a skeleton after blanking and cupping. The work progresses linearly through the press normal to the direction of the strip (scrap) movement. Vacuum or electromagnets associated with each stationary pedestal hold down or assist in retaining control of the workpiece cup or container until shifting is desired.

The cam actuated transfer means with individual cam controlled finger sets is caused to precisely grasp the drawn cup just below its flange or rim and shift it to the next station where it is precisely aligned with the tooling for the next drawing operation. The fingers of the advancing mechanism carriage continue to exert some control over the workpiece until the rising draw die causes the cup to engage the pilot ring of the draw punch. At this point, the fingers are cammed open as control of the work is now by the tooling.

After completion of the first stage of drawing, the partially drawn cup is longer and narrower, it descends with the die to a stationary support pedestal axially centered within its die. The pedestal retains the drawn cup until it has been fully grasped by a finger set at which time it is released and the shifting motion of the advancing mechanism carries the cup to the next station. The cup is held by the fingers until it is again caught between the dies for forming. The process is then repeated and the cup is further drawn into a longer and narrower container. As the lower die moves downward the bottom of the container is pressed against the next stationary pedestal. As before the container is retained until the fingers of the advancing mechanism once again grasp the container's upper side wall below the rim or flange for movement to the next forming station. Any number of stations can be used, but, in the preferred embodiment there are four stations: the first for blanking and cupping; the second for drawing; the third for redrawing and/or bottom profiling and the fourth for trimming the flange to a predetermined diameter. When the drawn container is placed at the fourth station, the lower die raises up about the container until the lower surface of the flange is captured between the lower die and upper dies. There the dies cooperate to shear the flange along the preset diameter. As the dies part the ring of flange scrap follows the lower die downwardly, and at the same time the container is lowered to the pedestal. The scrap ring continues to fall with the die movement to a pair of horizontally cammed rails which move in and out in a plane above the top of the pedestal. The advancing mechanism then grasps the container and begins to shift it and the scrap ring from the pedestal area to a point where the axis of the container is in alignment with a fifth station for lifting the container to a magnetic discharge conveyer. An air jet is used to force the scrap ring upwardly with the container and a further set of upper rails are positioned to carry the scrap ring out of the press with the magnetically conveyed container.

BRIEF DESCRIPTION OF THE DRAWINGS

FIG. 3 is a partial fragmentary elevational view looking at the side of the elevator and conveyer which supplies the strip into the feed mechanism for the press;

FIG. 3A is a view similar to FIG. 3 showing the stack of strip as lifted by the unloader fork from the conveyed pallet into position for feeding;

FIG. 3B is similar to FIGS. 3 and 3A but it shows the stack being supported by the feeder fork with the unloader fork lowered to receive a fresh stack;

FIG. 3C is similar to FIGS. 3, 3A and 3B, however, there the remaining strips of the depleted stack are now supported on spring loaded fingers;

FIG. 3D is a partial top plan view of the mechanism which extends and retracts the feeder forks which is shown retracted position in FIG. 3 and in extended position in FIGS. 3A or 3B;

FIG. 7 is a longitudinal elevational view taken transversely along line 7—7 of FIG. 5 and showing the stripping mechanism for the can flange scrap; and FIG. 8 is a top plan view in cross-section along line 8—8 in FIG. 7 and showing the details of the stripping mechanism.

DETAILED DESCRIPTION OF THE DRAWINGS

Figure 1:
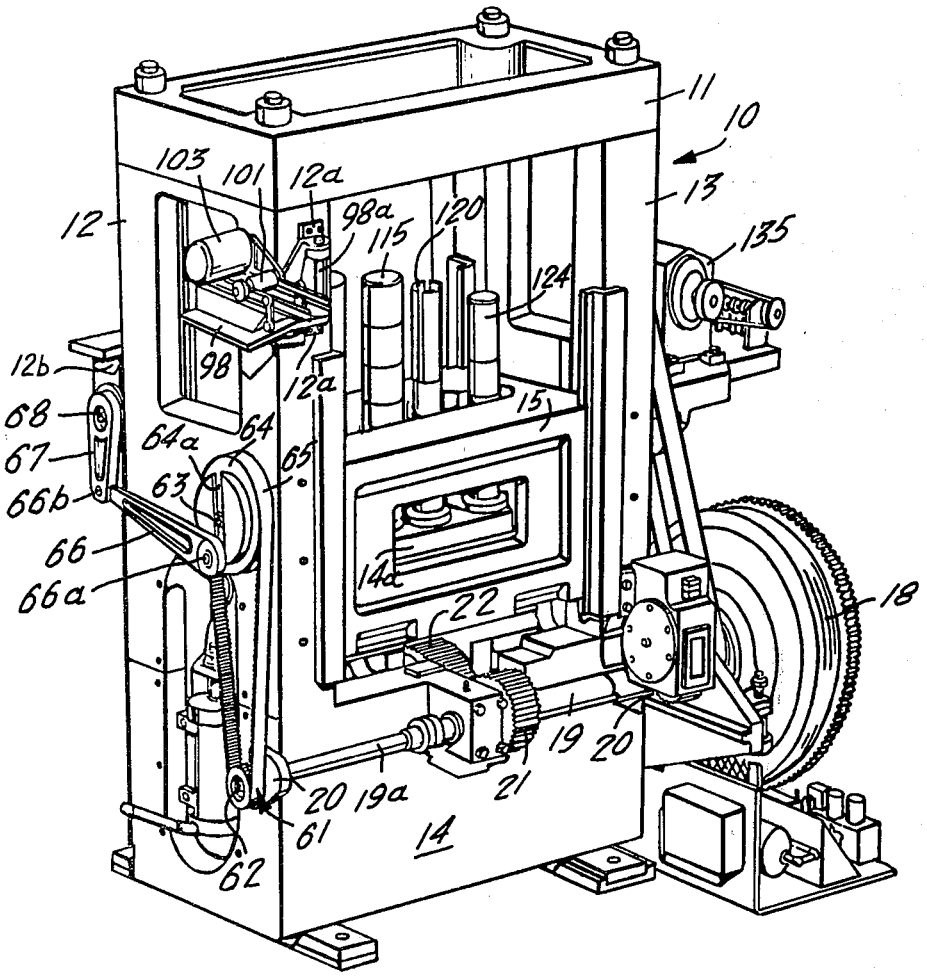
FIG. 1 is an overall front perspective view of the preferred inverted press of the present invention.

FIG. 1 shows an overall front perspective view of the preferred press of the present invention. The press is inverted and is designed to simultaneously perform multiple operations in a progressive manner. More particularly, there is a press frame generally designated 10 having a crown or top member 11 which rests horizontally across a pair of press side walls 12 and 13. Top member 11 forms a lentil-like structure adapted to carry the upper portion of the tooling die (not shown in FIG. 1). The side walls 12 and 13 rest on a base 14 being an upwardly open box-shaped hollow structure for carrying the driving mechanism of the press. A slide assembly 15 is carried for verticle reciprocating motion along and between the walls 12 and 13 and is adapted to support the lowered die (not shown in FIG. 1) or tooling for the press. Similarly, the upper tooling is also deleted from FIG. 1 in an effort to clarify some of the features and details of the press. The press is inverted in that the slide assembly 15 is underdriven by a crank mechanism (not shown in FIG. 1).

Figure 2:
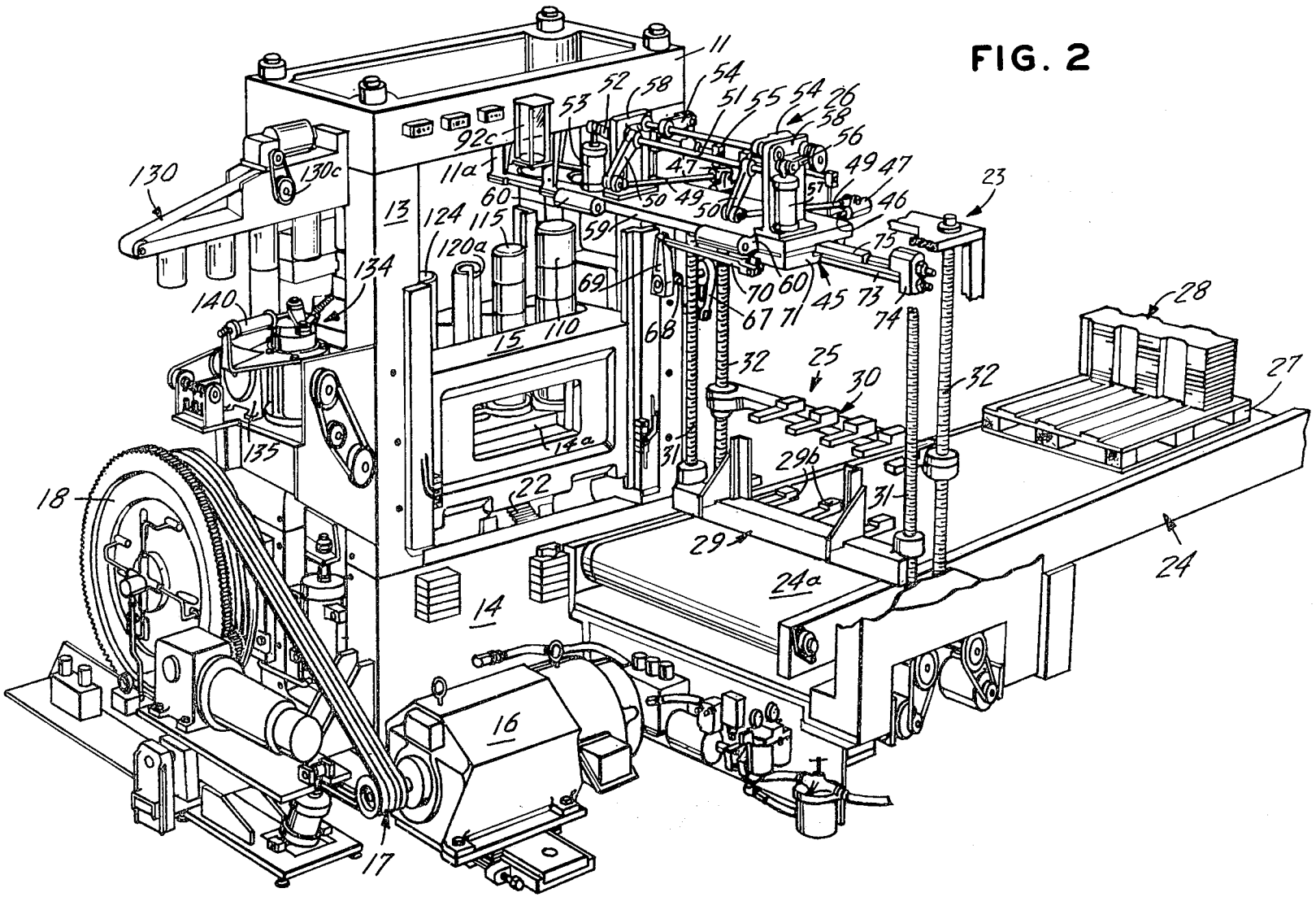
FIG. 2 is a rear perspective view of the press feed including the conveyer and elevator system which feed individual strips into the press.

FIG. 2 is a perspective view of the back of the press. More particularly, a drive motor 16 is positioned adjacent the base 14 and is by belt and pulley assembly 17 connected to a fly wheel air clutch mechanism 18 in a manner suitable for reducing the motor speed to an appropriate speed for driving a jack shaft 19 (shown in FIG. 1). The jack shaft 19 is horizontally positioned by pillow bearings 20 on the side wall of base 14 opposite the side on which motor 16 is located and jack shaft 19 extends in parallel relation to the side of base 14. Intermediate bearings 20 is a main drive pinion gear 21 arranged to drivingly engage and rotate at a reduced speed a larger main drive gear 22. Main drive gear 22 is a part of the press crank shaft (not shown in FIGS. 1 or 2) which is drivingly connected to the slide assembly 15 for purposes of reciprocating same within the confines generally established by side walls 12 and 13 of the press.

Adjacent the motor 16 along side the press base 14 (as shown in FIG. 2) is a feeder assembly 23 consisting of a motorized roller conveyor 24 adapted to automatically present stock for processing in the press. More particularly, the feed assembly 23 has an elevator mechanism 25 which is disposed vertically adjacent to side wall 13 and in alignment with an inserter mechanism 26 carried just beneath member 11 for inserting individual strips of stock into the press in line with a first blanking and cupping station.

The conveyer 24 operates to transport pallets 27 with feed stacks into the elevator mechanism 25. More particularly, as shown in FIGS. 2 and 3, a pallet 27 is moved on the motorized conveyer 24 into the elevator mechanism 25. On the pallet 27 is a feed stack 28 which is typical of the material necessary for processing into drawn containers. The conveyer 24 moves the pallet 27 toward the elevator 25 whereat a set of longitudinally extended unloader fork 29 located just above the conveyer 24 extends into the pallet 27 beneath the feed stack 28 in position to lift and support the feed stack 28 independently of the pallet 27. Once captured by the unloader fork 29, the feed stack 28 is raised away from the surface of the conveyer 24 and into position for feeding into the press. A pair of ball screws 31 are located at each side of unloader fork 29 and rise vertically from the conveyer bed **24*a* to the level of the crown 11. Rotation of ball screws 31 raises or lowers the unloader fork 29 in an elevator fashion. The elevator mechanism 25 is primarily located above the bed 24*a* of the roller conveyer 24, and the lowest position of unloader fork 29 is a distance slightly greater than the height of the pallet 27, such that the pallet 27 can move under the unloader fork tines 29*b* permitting at a later time the alignment of an additional stack 28** above the unloader fork 29. In order to free the unloader fork 29 for lowering to lift further stacks of material, there is on the elevator assembly 25, an additional feeder fork assembly 30 to extend under the raised lifted stack.

In FIG. 3D the feed fork 30 is shown. It has movable tines 30*a* operated by a crank 30*b* activated by a power cylinder 30*b*. The main frame 30*d* of the feed fork 30 is carried on a pair of ball screws 32 similar to the way unloader fork 29 is carried on their ball screws 31. Consequently, crank 30*b* pivots relative to frame 30*d* under urging of cylinder 30*c* thereby moving tines 30*a* relative to frame 30*d*, see FIG. 3D. Once freed from the burden of stack 28 the unloader fork is able to lower and receive another stack 28. The lifted stack 28 is held at a level for feeding strip by means of raising the feed fork 30 as necessary.

Schematic FIGS. 3, 3A, 3B, 3C and 3D show the various states of operation of the unloader 29 and feeder fork assembly 30. In FIG. 3, the unloader fork 29 is raising the first stack 28 of strip stock from pallet 27. The raised position is shown in FIG. 3A, and is shown in its feeding position in FIG. 3B. A pair of sensors for high and low level are designated 33 and 34 respectively. High level sensor 33 stops the unloader fork 29 at its uppermost position and low level sensor 34 raises the stack 28 to the high level. The sensors 33 and 34 can be of a photoelectric variety or of a limit switch type. As the strips of stock are lifted from the top of the stack 28 by suction cups 35 to a magnets 36 the level of the stack decreases and trips the sensor 34 causing the elevator mechanism 25 to raise the unloader fork 29 until the stack 28 is diminished to the point where the unloader fork 29 is in line with the bottom position for the feed fork 30. Then the feed fork 30 extends under the stack 28 and lifts same from the unloader fork 29. Thereafter feed fork 30 feeds the stack 28 until the low level sensor 34 no longer senses the strip at which point the remaining strips are held by spring loaded fingers 37 as will be explained later. Then the feeder fork assembly 30 is able to move downward and retract so that the unloader fork 29 can lift another stack 28.

Limit switches are provided to control the position of the stacks 28, more particularly in FIG. 3 the pallet 27 is moved along conveyer 24 until limit switch 38 is closed at which point the conveyer stops. Similarly, loader fork 29 is raised until limit switch 39 is closed, as depicted in FIG. 3A, and finally limit switch 40 is connected to spring fingers 37 such that a signal is transmitted when spring fingers 37 have moved to support the remaining stack 28, FIG. 3. In operation the limit switches 38, 39 and 40 co-act to control the supply of strip available to the suction cups 35. By means of unloader fork 29, feed fork assembly 30 and/or the spring loaded fingers 37 a supply of strip is continuously maintained at a level between the high and low sensors 33 and 34. More particularly, the feed fork 30 as previously explained pushes the stack 28 up between the spring loaded fingers 37 (as shown in FIGS. 3A and 3B). Each finger 37 is mounted to slide in a channel 41 which permits the top portion of each 37*a* to be biased towards the stack. When the stack diminishes to a few remaining strips (as shown in FIG. 3) the spring loaded fingers 37 which were riding against the sides of the stack 28 (FIGS. 3A and 3B) are now urged by springs 42 to slide within 41 underneath the stack 28 and retain same against downward motion when the feed fork 30 is lowered and retracted so as to be in a position to receive a new stack. Spring fingers 37 including an upper land 37*a* adapted to reach underneath the bottom of the remaining stack of strip 28 (as shown in FIG. 3) and carry the remaining strips.

Magnets 36 are horizontally disposed above the stack 28 and are arranged with a surface in a plane slightly above the tin line within the press. Consequently, as vacuum cups 35 are reciprocated vertically to lift the top strip off the stack 28 the magnets 36 act to retain the strip so that the suction cups 35 can release them. Lifting an individual strip is assured by means of pickers 43 arranged and supported slightly above the stack and extending normally into the path through which the vacuum cups 35 pull the top strip toward the magnets 36. Each picker 43 is an acerous shaped protuberance which frictionally contacts the edge of the strip in order to assure that a second strip is not carried along therewith. More particularly, the pickers 43 engage the top strip with a force insufficient to overcome the pull of the suction cups 35 but adequate to separate the top strip from any that may stick to it from beneath and be carried therewith. The pickers 43 thus tend to fan the edge of sticking strips much like a deck of cards are fanned to separate them during shuffling.

An inserter mechanism 26 is located above the top of the positioned stack 28 such that the strip lifted and retained by magnets 36 can be pushed laterally thereacross into a strip feed mechanism 45 (see FIGS. 3, 3A, 3B and 3C). Inserter mechanism 26 includes rod shaped guides 46 which horizontally extend above the magnets 36, and, in general alignment parallel thereto such that a sliding bushing 47 may ride on each guide rod from a first position away from the strip feed to a second position near strip feed 45 (see FIGS. 3B and 3C) respectively. Slide bushing 47 carries on it a downwardly extending tab 48 positioned to engage the edge of a strip carried by magnet 36 and push same across magnets 36 to the strip feed 45 as best shown in FIGS. 3B and 3C. The slide bushings 47 are moved in time relation by a drive links 49 which reciprocate in time relation to the needs of the press for strips to be formed. More particularly, in FIG. 2 drive links 49 is shown attached to a pair of connecting rods 50 which oscillate about a drive bar 51 by an arm 52 connected to a power cylinder 53. Similarly, vacuum cups 35 are raised and lowered by a pair of arms 54 which are supported on a drive bar 55 oscillated by a cylinder arm 56 moved by a power cylinder 57. Bars 55 and 51 are horizontally disposed and trunnionly supported between upstanding vertical trunnions 58. Each trunnion 58 is carried on a cover 59 for the strip feed assembly 45 and cover 59 is hingeably mounted to the strip feed 45 by a pair of hinges 60 which are connected on the side of the feed mechanism 45 opposite where the strips are inserted.

In FIG. 1, connected to jack shaft 19, at its end opposite the clutch 18, it drives a pulley and cog belt system 61 including lower cog pulley 62 attached to the jack shaft 19. The system 61 is arranged to carry the rotation to an upper cog pulley 64 supported on an upper cog pulley axle 63 mounted to the exterior side of frame 12 about which the upper cog pulley 64 can idle. Connecting the pulleys 62 and 64 for driving relation is a cog pulley belt 65 such that the rotation of jack shaft 19 acts to turn the lower cog pulley 62 at a speed which is greater than the larger upper cog pulley 64 turns. On the face of the upper cog pulley 64 is a diametrically positioned face groove which is adapted to cooperate for adjustably driving a connecting link 66. More particularly, an adjustably positioned axle 66*a* is arranged to mount within the face groove 64*a* at a predetermined position spaced from the center of axle 63. The spacing of the axis of axle 63 further from the center gives link 66 greater travel. Connecting link 66 operates in a generally horizontally plane and acts to generate a side to side motion when cranked by rotation of the upper cog pulley 64. The end 66*b* of connecting link 66 (opposite the axle 66*a* mounted end) is pivotally joined to an oscillating arm 67 which extends from driven end 66*b* upwardly to a drive shaft 68 in FIG. 2. Drive shaft 68 is trunnionly supported along side 12 of the press frame to permit rotation while it is supported in a horizontal attitude. At the end of drive shaft 68 opposite the end to which oscillating arm 67 is connected is another feed arm 69, and arm 69 extends upwardly from drive shaft 68 to a feed drive rod 70 which extends away from the press, and, in general, parallel relation to feed mechanism 45. The feed drive rod 70 is positioned beneath the feed mechanism 45 to transmit the motion imparted by arm 69. Feed drive rod 70 oscillates toward and away from the press. The throw of feed drive rod 70 can be varied by adjusting the position of the adjustable axle 66*a* relative to the axis of axle 63.

Figures 4, 4A:
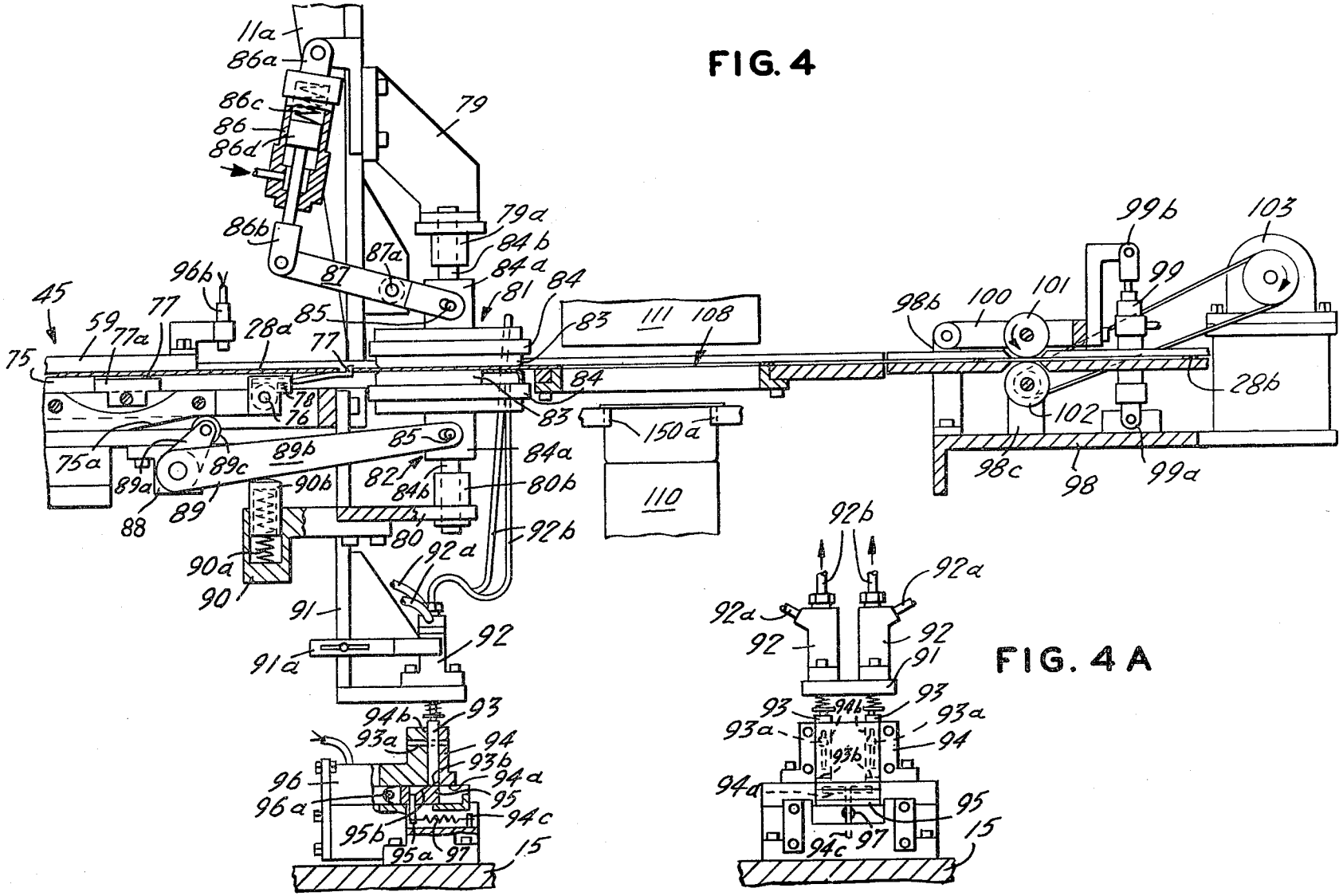
FIG. 4 is a longitudinal view taken transversely through the press showing the strip feed mechanism the lubrication mechanism and the scrap discharge in a partially cross-sectional side view.
FIG. 4A is a partial front elevational view of a portion of the lubricating system of FIG. 4.

As shown in FIG. 3 the feed drive rod 70 is connected to a guide block 71 which is supported by guide ways 73 being a part of the feed mechanism 45 (see FIG. 2). The throw of rod 70 is assured of being controlled in and out motion which is transferred from the guide block 71 to a drive bar 73 mounted thereto at one end and having a threaded connection at the other (see FIG. 2). The drive bar 73 passes through a connecting block 74 which acts to adjustably support a pawl bar 75 (FIG. 2) so the respective positions of the drive bar 73 and the pawl bar 75 can be adjusted relative to one another by means of their threaded ends. The pawl bar 75 is carried in a guide slot 45*a* (FIGS. 3,3A,3B and 3C) for controlled reciprocation toward and away from the press. Carried on the pawl bar 75 are a number of pawl pivots 76, each is horizontally disposed and extends outwardly from the side of the pawl bar 75 (FIG. 4). Each pivot carries a pawl 77 which is rotatably mounted thereon and is adapted to extend upwardly from the pawl bar 75 (as shown in FIGS. 3, 3A, 3B and 3C). In order to urge the pawl 77 upwardly about its pivot 76 each pawl includes a pawl spring 78 (see FIG. 4).

In FIG. 4 the processing of a strip of stock 28*a* is shown as it moves from the feed mechanism 45 transversely through the lubricating area into the first station of the press die where it is blanked and cupped and a skeleton 28*b* is left. Each strip 28*a* is lubricated in the area between the feed mechanism 45 and the first station of the press die. More particularly, a bracket 11*a* which hangs downwardly from the crown 11 of the press supports lubricating mechanism which includes an upper lubricating pad assembly 81 and a lower lubricating pad assembly 82. Between bracket 11*a* and assembly 81 is a support bracket 79 which has a bushing 79*a* disposed to receive the support 84 for the upper pad assembly 81. More particularly, support 84 consists of a hub shaped portion 84*a* and a cylindrical rod 84*b* extending outwardly therefrom. The cylindrical rod 84*b* is designed to cooperate with bushing 79*a* to permit controlling linear motion along an axis normal to the surface of the strip 28*a*. The hub portion 84*a* includes a flanged end having manifold passages and support means for a lubricating pad 83 which is composed of absorbent material designed to spread the manifolded lubricant across the contact surface of pad 83 such that a predetermined spot of lubricant can be applied to the upper surface of the strip 28*a* when the moistened pad 83 is pressed against it. The movement of the assembly 81 is controlled by a power cylinder 86 which is mounted between bracket 11*a* and a lever 87 pivotally mounted at 87*a* to a portion of bracket 11*a*. On each end of power cylinder 86 are clevis connections to permit limited arcuate motion in a plane. More particularly, the top of cylinder 86 has a clevis 86*a* attached to extend from bracket 11*a* and the bottom of cylinder 86 has a clevis 86*b* arranged to connect to one end of lever 87.

Pivot 87*a* is near the middle of lever 87. The other end of lever 87 is shaped and arranged to mount over pivot pins 85 extending from the hub portion 84*a* of the pad assembly 81. Power cylinder 86 includes a piston 86*d* which is activated by air pressure transmitted to the bore of the cylinder 86 in time relation to the intermittent motion of the strip 28*a* as it pauses in the lubricating area. Above piston 86*d* is a return spring 86*c* which is designed to cause the piston 86*d* to move downwardly in the bore when the air pressure is released. When the air pressure is admitted to the bore the piston 86*d* rises thus moving the pad assembly 81 downwardly toward the surface of the strip 28*a*.

The lower pad assembly 82 is similar in operation and parts which are identical have similar numbers to those used in connection with assembly 81. Instead of a power cylinder to move the assembly there is a bell crank 89 supported for pivotally movement by a pillow bearing 88 attached to the bottom of feed mechanism 45. Feed mechanism 45 is supported by bracket 11*a*. Crank 89 has a short leg 89*a* and a long leg 89*b*. The short leg 89*a* extends generally upward from the axis of the crank 89 and includes a roller follower 89*c* which rides against a pawl bar cam 75*a*. The elongated leg 89*b* of crank 89 extends generally horizontally toward the pivots on 85 on the hub 84*a* of the lower pad assembly 82. Thus as the feed machanism 45 shuttles strip, the movement of the pawl bar 75 carries cam 75*a* moving crank 89 to reciprocate lower pad assembly 82 along its support rod 84*b* carried within a bushing 80*b* on a bushing bracket 80. Bracket 80 is also affixed and carried by the bracket 11*a*. Beneath the long leg 89*b* of crank 89 is a return spring bracket 90 which includes a compression return spring 90*a* contained in a bore in bracket 90 by a cup-shaped spring cap 90*b*. Consequently, the follower 89*c* is urged by spring 90*a* against the cam 75*a*.

Extending downwardly from spring bracket 90 is a pump bracket 91 which includes an adjustable pump support 91*a* set laterally across to a positive displacement pump 92 supported by pump bracket 91.

Two American Bosch Corporation injection pumps type #PLB1A-60A-2326-A have been found to perform satisfactorily in this application. Each pump is mounted so that its activating portion extends downwardly from bracket 91 and its supply and return connection extends generally upwardly therefrom. More particularly, oil is supplied to the pumps through tubes 92*a* and is pumped through tubes 92*b*.

One of the tubes 92*b* connects to lower pad assembly 82 and the other to upper pad assembly 81. The tubes are of a flexible material such that the reciprocal motion of the pad assemblies can be accommodated. A supply reservoir 92*c*, shown in FIG. 2, is located above and adjacent bracket 11*a*. To activate the injection pumps there are pump drive bars 93 which are carried in separate parallel verticle bores of a drive bar support block 94 which is mounted to the press slide 15. More particularly, as the press slide 15 moves upwardly it carries the drive block 94 with it and when the pump drive bars 93 are in the position shown in FIGS. 4 and 4A, the injection pumps 92 are activated.

It should be appreciated that it would not be desirable to activate the pumps 92 when there is no strip 28*a* being delivered from the feed mechanism 45 to the lubricant area. In order to lower the drive bars 93 such that they are out of the range of the pumps 92, when the press slide reaches the top of its stroke there is a movable shuttle 95 supported in a transverse tunnel 94*a* in block 94. The shuttle 95 is activated by a solenoid 96 mounted at one end of block 94 and arranged to pull the shuttle 95 against the urging of a tension spring 97. Spring 97 is connected at one end to a pin 95*a* which extends downwardly from the shuttle 95 and moves therewith and at its other end to a pin 94*c* extending upwardly within block 94. Solenoid 96 is connected to the shuttle 95 by a clevis connection 96*a* and is activated by means of a strip sensor 96*b* located above the bed of the feed mechanism 45 near the lubricating area for sensing the strip 28*a*. When sensor 96*b* finds a strip 28*a* a current is applied to the solenoid such that the shuttle 95 is drawn toward the solenoid 96 (against the urge of the spring 97) and the drive bars 93 are raised to their highest position.

Drive bars 93 are carried in a bore 94*b* such that they are permitted to move vertically. In FIG. 4A, pins 93*a* are shown, each extends through a slot in its respective drive bar 93. Pins 93*a* prevent rotation of bars 93 relative to their bores 94*b*. At the bottom of each drive bar 93 is a cam ramp 93*b* which is designed in cooperation with a similar ramp 95*b* on shuttle 95. When the solenoid releases the shuttle 95, spring 97 urges same away from the solenoid 96 thus aligning ramps 93*b* and 95*b* permitting the drive bars 93 to drop relative to support block 94. Consequently, the drive bars 93 are unable to contact the pumps 92 and supply the energy necessary to distribute the oil in the supply tubes 92*b*. As is apparent from FIG. 4A, there is one pump 92 for the upper assembly 81 and another 92 for the lower assembly 82. The shuttle 95 is arranged to control both pump drive bars 93 and thereby eliminating oil pumping when a strip 28*a* is not in position to be lubricated.

FIG. 4 shows the first die station of the press in a rather schematic form; the details of the press dies will be explained in connection with other figures. It will be sufficient to say that the strip 28*a* is blanked leaving holes therein and a remaining skeleton 28*b* which proceeds across the press and into a scrap removal device. More particularly, there is a scrap drive support 98, shown in FIG. 4 and also in FIG. 1. In FIG. 1 the support 98 is mounted on scrap drive support hinge pivots 12*a* affixed to the side 12 of the press frame. The pivots 12*a* carry a scrap hinge pin 98*a* which is designed to carry support 98 so that it can be rotated into its operating position or away therefrom as needed during operation (FIG. 4) or servicing (FIG. 1) of the press.

In FIG. 4, support 98 is shown in its operating position. On support 98 there is an upwardly extending roller support bracket 98*b* which is arranged to carry a pivot for an upper roller bracket 100 whereby an upper roller 101, being an elongated cylinder member, is able to rotate thereon and pivot from a position against the scrap skeleton to position away from the scrap skeleton 28*b*. The support 98 also includes a lower roller support 98*c* which carries a lower roller 102 in a position beneath the upper roller 101 so that they may be juxtaposed having axes parallel to one another. The upper roller bracket 100 is connected to a scrap power cylinder 99 which at one end 99*a* is connected by means of a clevis to the support 98 and the other end 99*b* is connected by a clevis to an extended part of bracket 100 such that the movement of cylinder 99 will move roller 101 away from or toward roller 102. The surface of roller 102 has knurling in order to provide a tractive surface to drive the scrap skeleton 28*b* out of the nip of the rollers 101 and 102 and out of the press.

A motor and drive belt 103 is mounted on support 98 such that lower roller 102 is driven in clockwise fashion, (FIG. 4). The operation the power cylinder 99 is used to bring roller 101 down upon the scrap skeleton 28*b* such that the rotating roller 102 will drive the scrap skeleton 28*b* out of the press in timed relation to the shifting of the next strip 29*a*. Follower 101 acts as a roller follower and rotates counterclockwise when subject to the driving force transmitted by lower roller 102.

Figure 5:
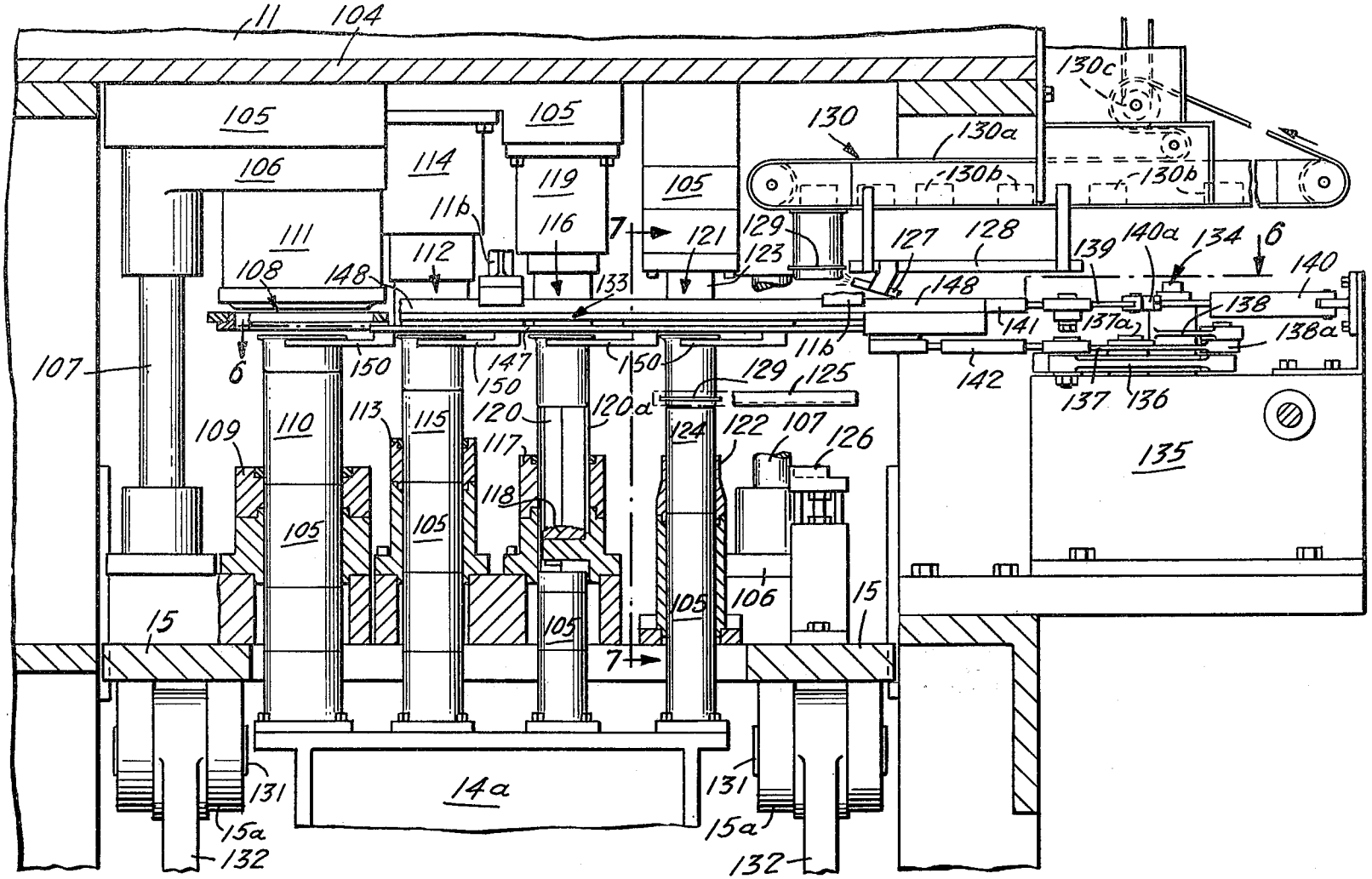
FIG. 5 is a longitudinal side elevational view of the press die and transfer mechanism with particular emphasis on the stationary pedestals and the can conveyer.

FIG. 5 is an enlarged side elevational view showing a partial cross-sectional view of the die and transfer mechanism for the press. All of the drawing and redrawing stations in the press are shown with exemplary containers positioned as they would appear during the press cycle after the part has been formed and the transfer mechanism is just grasping same to begin transfer to the next station. The dies are located between the slide 15 and the crown 11. Attached to the crown 11 is a flat horizontally disposed bolster plate from which hangs the upper portion of the die set or punches. A number of spacers all labelled 105 are located throughout the die set and are used in order to adjust the positions of the various components for purposes of allowing the locating of different die sets for making particular can sizes. That is to say, that by adjusting the size of the spacers 105 and their relative positions various different punch and die arrangements can be used between the slide 15 and the bolster plate 104.

The press die set is controlled by a leader pin guide system. A punch shoe 106 is shown supporting leader pin 107 on the left side of FIG. 5. On the right side the leader pin 107 has been partially cut away in order to better display certain aspects and features of the press. The strip 28*a*, as shown in FIG. 4, is fed to the initial station for blanking and cupping 108 in FIG. 5 by shifting the strip 28*a* one cut edge plus a scrap allowance with each stroke of the press. The initial station for blanking and cupping 108 includes a preliminary die 109 which severs a blank or disc of metal of a predetermined diameter.

Preliminary die 109 moves upwardly with each stroke of the press slide 15 about a stationary pedestal 110 concentrically located within blanking and cupping die 109. Pedestal 110 is supported at a height where its top meets the bottom of the drawn cup and holds same so that the flange thereof is in a predetermined plane slightly below the tin line. Pedestal 110 is supported by a base cavity support 14*a* which rises up from the bottom of the press through an opening in the slide 15. Support 14*a* is fixed and does not move with each stroke of the press, therefore, the pedestal 110 is always positioned to receive blanked and drawn cups e.g. formed in the initial station for blanking and cupping 108.

Above pedestal 110 is the initial station punch and hold down 111. In a manner well known the punch and hold down 111 is resiliently biased downwardly toward the tin line. As the preliminary die 109 is raised by the slide 15, it first severs a blank against the force of the punch and hold down 111 then continues to draw the severed blank upwardly about the punch as the hold down controls the feeding of material from the flange area into the walls of the cup. The biasing of the punch and hold down are different and are adjusted in accordance with the desired result, i.e. an unwrinkled flange and a smooth unscored cup wall. After the die 109 has reached the top of its stroke it begins to lower bringing with it the formed cup which is brought to bear upon the top of pedestal 110. The die 109 continues to descend about the pedestal 110 leaving the cup atop the pedestal. Although not shown, it may be desirable to include vacuum passages or magnets in the top of the pedesal 110 to assure that the cup will not shift relative to its centered position on its pedestal until it is desired to do so.

In an effort to simplify the discussion of the dies, the explanation on how the cup is transferred so that its axis is aligned with the axis of the next forming station called the the first redraw station will be delayed until later. It will be assumed that such transfer takes place and the mechanism for doing so will be explained in detail in connection with FIG. 6. For the moment, the explanation of the progressive drawing and redrawing of the initially formed cup will procede without further explanation of the transfer mechanism details. In the first redraw station 112 the cup is held in position with its flange slightly below the tin line of the press. As the slide 15 is raised a first redraw die 113 comes up and meets the bottom of the cup which has a diameter larger than the diameter of the first redraw die 113. Consequently, the cup is pressed upwardly against a punch and hold down for the first redraw 114. The first redraw punch and hold down 114 is supported in axial alignment above the die 113 by the bolster plate 104 and a spacer 105. There is a stationary pedestal 115 axially aligned with punch 114 and die 113 and is carried upon support 14*a*. Pedestal 115 is designed to receive the cup after it is redrawn in the first redraw station 112 where it becomes longer and thinner. More particularly, the first redraw die 113 is raised with the stroke of the slide 15 pressing the bottom of the cup upwardly towards the hold down and punch 114 and redrawing the cup to an elongated container in accordance with the configuration of the first redraw punch 114. After the top of the stroke is reached, the die 113 starts to descend carrying with it the redrawn container toward the top of pedestal 115 where it is held in a manner similar to that described for pedestal 110. As the slide 15 approaches the bottom of its stroke the redrawn cup is transferred to the next station in the press where the second redraw and bottom profiling take place.

The second redraw and profiling station 116 includes a second redraw die 117 and a bottom profile die 118. The redrawn cup has a larger diameter than the second redraw die 117 and is captured between the redraw die 117 and a second redraw punch and hold down 119 as the slide 15 moves upwardly. The second redraw punch and hold down 119 are carried by the bolster plate 104 and a spacer 105 in axially alignment with the axis of the second redraw die 117 and the bottom profiling die 118. As the stroke of the slide 15 continues the second redraw die 117 in cooperation with the second hold down and redraw punch 119 stretches and elongates the container to the configuration of the punch in a manner similar to that of the first redraw die set 112. As the stroke is completed the second redraw die 117 reverses its direction and brings with it the redrawn container placing same upon a hollow pedestal support 120.

Pedestal support 120 is carried by spacer 105 at the proper height to assure that the flange of the formed container is maintained near the tin line. Hollow support pedestal 120 is adapted to permit a profile die to reach the bottom of the container as the slide 15 moves upwardly during its stroke. For that purpose the hollow support pedestal 120 has an opened longitudinal slot as shown in FIG. 5 and labelled 120*a*. The slot 120*a* is arranged to permit a part of the die 117 to connect with die 118 whereby profile die 118 is carried along with the second redraw die 117 during the second redrawing operation.

The container is then transferred so that its axis is in alignment with the next station called the flange trimming station 121. Here the flange is severed to a preset diameter concentric to the axis of the redrawn container. The flange trimming die 122 is carried about a support pedestal 124 and in axial alignment with the axis of the container and the flange trimming punch and hold down 123 which is supported just above the tin line. As the press slide 15 moves upwardly the flange trimming die 122 is brought to bear against the bottom of the flange raising same against a hold down and trimming punch which severs the flange leaving a ring of scrap to descend with the trim die 122. A pair of rails 125 are horizontally disposed alongside the container in position to catch the scrap ring. The details of the intercooperating moving relationship of the rails 125 and the trim dies 122 will be described in greater detail in connection with FIGS. 7 and 8 which follows.

Rails 125 are sufficiently close to the sides of the container to catch the scrap ring and prevent same from dropping with the flange trimming die 122.

The container is then transferred to the next station called the discharge lifting 126, which is a platform which rises the container to a magnetic discharge conveyer 130. More particularly, as the container and the circumscribing scrap ring are lifted by the discharge lifter 126, air jets 127, in FIG. 5 are directed toward the bottom of the container to maintain the scrap ring in its position about the container so that the scrap ring is carried to the height of the upper guide rail system 128. The guide rails 128 are spaced apart sufficiently to permit the containers to pass therebetween but close enough to carry the scrap ring 129 so that it does not fall from the container as the container is moved out of the press by magnetic conveyer 130.

Magnetic conveyer 130 includes a belt 130*a* which is caused to pass beneath magnets 130*b* by a drive system 130*c*. The belt is of a material which is permeable to the magnetic flux whereby the remaining flange on the container is attracted to the belt to be removed therewith out of the press. At the end of rails 128 opposite where the discharge lifter is located the scrap ring 129 is permitted to drop but the container is carried by the magnetic conveyer 130 a somewhat further distance where it can be captured by another container conveyer system, not shown.

One other detail shown in FIG. 5 is the driving system for the slide 15. More particularly, attached to the bottom of the slide 15 are trunnions 15*a* which depend downwardly beyond and are adapted to receive the top part of crank arms 132. The trunnions 15*a* are connected in pivotal relationship to the crank arms 132 by wrist pins 131. Crank arms 132 extend downwardly to the crank and are in a well known manner moved to reciprocate the slide 15.

Figure 6:
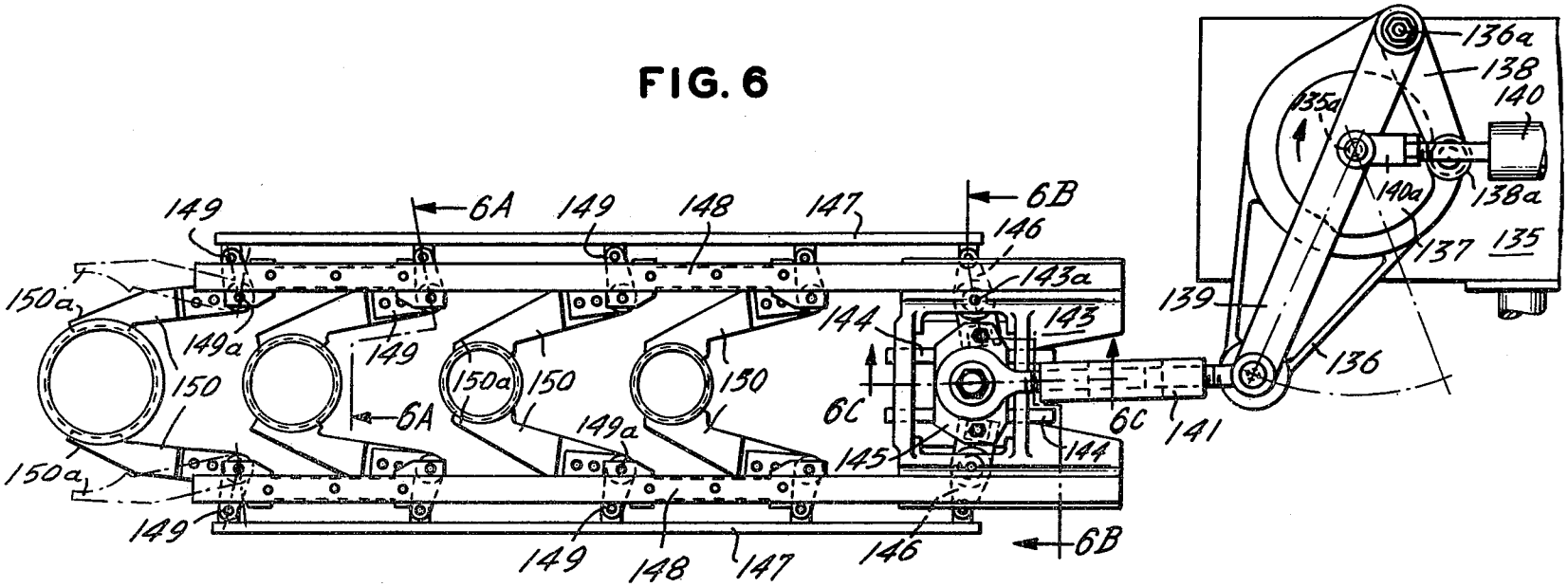
FIG. 6 is a top elevational view of the can transfer mechanism taken along line 6—6 in FIG. 5.

Turning now to FIG. 6, the mechanism for transferring the container from its initial blanking and cupping station 108, to its first redraw station 112, to its second redraw and profile station 116, to its redraw flange trimming station 121 and to the discharge lifter 126 is shown. The mechanism consists of a series of finger sets which are arranged to pivot toward one another in order to grasp the container about its circumference below its flange and transfer same from one station to the next.

A transfer mechanism 133 is shown in plan view in FIG. 6 and consists of two oscillating systems, one to transmit motion to the finger sets and one to move the entire transfer mechanism 133 sufficiently to place the finger sets in alignment with a first station to receive a partially formed container and a second station to release the partially forming containers for further forming. More particularly, there is a dual reciprocating drive 134 which includes transmission 135 that imparts a reciprocating angular motion to an oscillating arm 136. Arm 136 is driven about an axle 135*a* by a hollow oscillating shaft (not shown) also connected to transmission 135. The axle is arranged to also drive a rotary edge cam 137 independently from the oscillating arm 136. The edge cam 137 is positioned just about the arm 136. A bell crank having a short leg 138 is provided with a roller follower 138*a* set to trace and follow the edge of cam 137 as same is rotated. The bell crank short leg 138 is attached to a long leg or cam lever 139 at a pivoting point 136*a* mounted on the oscillating arm 136 whereby the lever 139 oscillates as a result of motion imparted to it by short leg 138 and by pivot 136*a*.

A shock damper 140 is connected to approximately the midpoint of lever 139 by means of a clevis 140*a*. In a manner common to a reciprocal device shock damper 140 acts to restrain any harmonic motion induced by the frequent velocity changes imparted to lever 139 during its oscillation. The driven lever 139 and arm 136 are connected to additional linkage for the transfer mechanism 133. Drive rod 141 is connected to lever 139, see FIG. 6C, and transfer rod 142 is connected to arm 136. Both rods 141 and 142 are arranged as a turn buckle having regular and reverse threads arranged such that the distance between the driving and the driven rods can be adjusted to a preferred length. Transfer rod 142 is connected to drive a chassis 143, see FIGS. 6, 6B and 6C, in reciprocating linear fashion. Chassis 143 is supported on the press crown 11 for controlled motion, the details of which will be explained later in connection with FIG. 6B. Chassis 143 carries with it slide bars 144 such that they may act to guide a finger block 145 driven for independent movement by drive rod 141. Consequently, the different reciprocations of the drive ends of lever 139 and arm 136 are imparted to interdependent systems. More particularly, they are interrelated to move linearly but they are independent in that the movements are not of the same periodicity or distance. Such motion is required in order to shift the finger sets to permit the transfer and in order to provide the opening and closing of the finger sets for purposes of grasping and releasing the container at the required times. The motion imparted to the finger block 145 is transferred to finger arms 146 which are carried about a pivot 143*a* carried on the chassis 143. The arms 146 are connected to drive finger connected bars 147 for purposes of supplying the relative independent motion as necessary for opening and closing the finger sets.

The chassis 143 is supported for limited horizontal sliding by means of transfer support guides 148 which lie in guide ways 11*b* depending from the crown 11 of the press. The guides 148 track along the ways 11*b* such that the motion of the chassis 143 is linear, planar and horizontal relative to the press. More particularly, the motion of the transfer mechanism 133 is in a plane parallel to and close by the tin line.

Figure 6B:
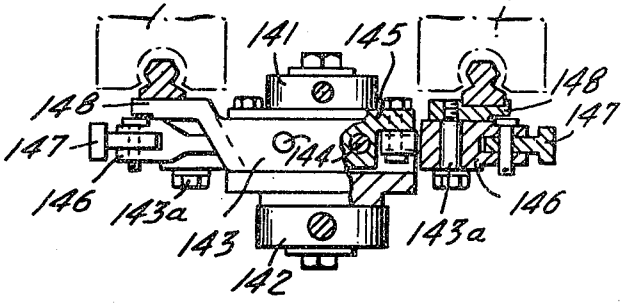
FIG. 6B is a fragmentary cross-sectional view taken along line 6B—6B in FIG. 6 of the mechanism which carries the transfer mechanism and oscillates the drive for the pivoting transfer fingers.
Figure 6C:
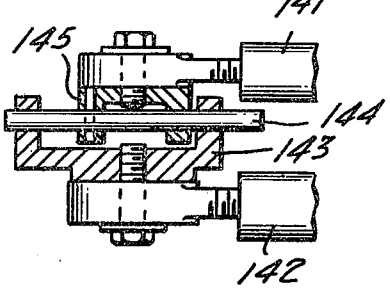
FIG. 6C is a partial side cross-sectional view taken along line 6C—6C of FIG. 6 showing the connections of the cam drive mechanism to the transfer mechanism.
Figure 6A:
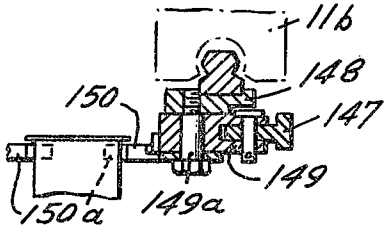
FIG. 6A is a fragmentary cross-sectional view taken along line 6—6 of FIG. 6 and showing details of the guidance system of the transfer mechanism fingers.

The finger connected bars 147 are attached to drive finger bell cranks 149 which are supported on crank pivots 148*a* depending from the transfer support guides 148; the relative difference in reciprocating motion imparted to the finger connected bars 147 and the transfer support guides 148 is manifest in an arcuate movement of the inner leg of the bell crank 149. Attached to the inner leg of each bell crank 149 is a light weight transfer finger 150. The transfer fingers 150 are preferably molded of a polymeric material to minimize their inertia (particularly in the distal portion 150*a* which is shaped to meet and grasp the container). There are a pair of fingers 150 in each finger set, such that they are able to move arcuately toward or away from one another under the swinging action of the bell cranks 149. In order to shift the partially formed and reformed containers there are four sets of fingers, each set is adapted to grasp and move a particular size container. The relative spacing of the finger sets and in particular, the shaped distal portions 150*a* when they are in their closed or together position is a function of the length of the fingers 150 in a set and their elongation relative to the inner leg of their respective bell cranks 149. Consequently, by merely changing the fingers 150, the transfer mechanism 133 can be adapted to handle by grasping, shifting and releasing the various size containers (throughout their range of drawn and redrawn configurations). In FIG. 6B the crosssectional details of the drive for the chassis 143 and its attachment to the finger connecting bars 147 are shown as are the mountings of the transfer support guides 148 in their respective guide ways 11*b*. Similarly, FIG. 6A shows the details of how the finger connected bars 147 drivingly connect to the finger bell cranks 149

To provide for catching the scrap ring 129 a mechanism 151 is detailed in FIG. 7. The transfer mechanism 133 is thus able to shift a partially formed container from alignment with the axis of one tool station to the axis of the next tool station. FIG. 7 is an elevational view taken transversely through the press from a place before the flange trimming station 121. The mechanism 151 moves the lower scrap guide rails 125 to and from the axis of the container. More particularly, the lower guide rails 125 are cammed in and out to enable them to catch the scrap and clear the trim die 122. The rails 125 are supported on rail support rods 125*a* which are bushed in pillow blocks 152 supported by brackets 11*c* depending from the crown 11. To actuate the flange scrap guide rails 125 in and out relative to the axis of the die 122 there is clevis-shaped follower 153 connected to the ends of the rail support rods 125*a* at the ends opposite the mounting of rails 125. Follower 153 carries a roller 154 between the arms of the clevis so that it rides against a linear cam track 155. More particularly, a pair of tracks 155, shown in FIG. 7, are mounted vertically atop the slide 15 and move with slide 15. As the slide 15 moves upwardly it carries the linear cam tracks 155 upward between the arms of the clevis follower 153 and translates the vertical motion thereof into a horizontal reciprocating motion which moves the rollers 154, the clevises 153, the rods 125*a*, and the guide rails 125 toward and away from the axis of the flange trimming die 122. The timing of the reciprocal horizontal motion of the guide rails 125 is such that as the flange trim die 122 is lowered the scrap 129 carried therewith is caught by the guide rails 125 since they move inwardly toward the flange trim die 122 at the same time as it is lowered whereby the scrap ring 129 lands on the rails 125. For the purposes of assuring that the roller 154 follows closely the contours of the linear cam track 155, there are tension springs 156 strung between the clevis 153 and the bracket 11*c*. Springs 156 maintain a rolling relationship between the rollers 154 and the cams 155 by pulling the rollers 154 toward the cams 155. As already set forth the rails 125 retain the scrap ring 129 about the circumference of the container so that the scrap ring 129 is carried with the container as same is further processed and gravity will act to easily separate the ring 129 from the container when same has left the press. Also shown in FIGS. 7 and 8 is the leader pin 107 and its support or punch shoe 106.

The invention and its many advantages will be understood from the preceding description of a preferred embodiment and skilled artisans will develop changes in form, construction, selection and arrangement of materials and components or changes in the steps of the method and process described without departing from the broader aspect of it as set forth in the claims that follow.

What is claimed is:

1. A method for transferring can bodies within a progressive forming press which receives sheet stock in a horizontal plane and blanks and cups same in a first station, draws the cup in a second station, redraws and bottom profiles in a third station, trims the flange in a fourth station and separates scrap ring and can body in a fifth station including the following steps:

(a) carrying slightly beneath the horizontal plane four sets of opposed fingers each pivotally mounted, each upon an axis and each designed to cooperate with its partner and each shaped to conform to the semifinished can body and said axes being fixedly disposed on a chassis means and each axis carried normal to the horizontal plane and said chassis means mounted to reciprocate substantially within the horizontal plane;

(b) timing the reciprocations of said chassis means to be substantially simultaneous with the periodicity of the press stroke and in particular with the opening of the slide therein;

(c) supporting a pair of connecting rods for the finger sets on said chassis means to reciprocate approximately in the plane with said chassis means and in the same direction but relative thereto for simultaneously driving said opposing fingers about their respective axes from a first position where the can body grasping ends of each finger set are apart to a second position where said can body grasping ends of each finger set are together about a semifinished can body; and (d) timing the maintenance of said first and second positions and the motion therebetween to the periodicity of the press stroke so when the slide therein is in its opening mode moving said grasping ends toward each other to grasp semifinished can bodies then holding same as said chassis means reciprocate to positions said bodies at the next adjacent station.

* * * * *